United States Patent [19]

Trudeau

[11] 4,032,868

[45] June 28, 1977

[54] MULTIMODAL HIGH PRESSURE WAVEGUIDE WINDOW

[75] Inventor: Ronald E. Trudeau, Goshen, Mass.

[73] Assignee: The United States of America as represented by the Secretary of the Navy, Washington, D.C.

[22] Filed: May 5, 1976

[21] Appl. No.: 683,590

[52] U.S. Cl. ..... 333/98 P; 333/34; 333/35; 333/98 M; 333/98 R

[51] Int. Cl.² ..... H01P 1/16; H01P 1/08; H01P 1/30; H01P 5/08

[58] Field of Search ..... 333/98 P, 98 R, 34, 333/35, 21 R, 98 M, 22 R, 22 F

[56] References Cited

UNITED STATES PATENTS

| | | | |
|---|---|---|---|
| 2,886,742 | 5/1959 | Hull | 333/98 P X |
| 3,001,160 | 9/1961 | Trousdale | 333/98 P |

*Primary Examiner*—Alfred E. Smith
*Assistant Examiner*—Marvin Nussbaum
*Attorney, Agent, or Firm*—R. S. Sciascia; G. A. Montanye

[57] ABSTRACT

A multimode waveguide window which provides an RF connection through a metal barrier such as the hull of a submarine. RF transmission is effected with a minimum of insertion loss and the structure is capable of withstanding hydrostatic pressures up to 1000 psi. In the event that the incoming waveguide structure is accidentally severed from the ship, the window provides a watertight seal.

4 Claims, 4 Drawing Figures

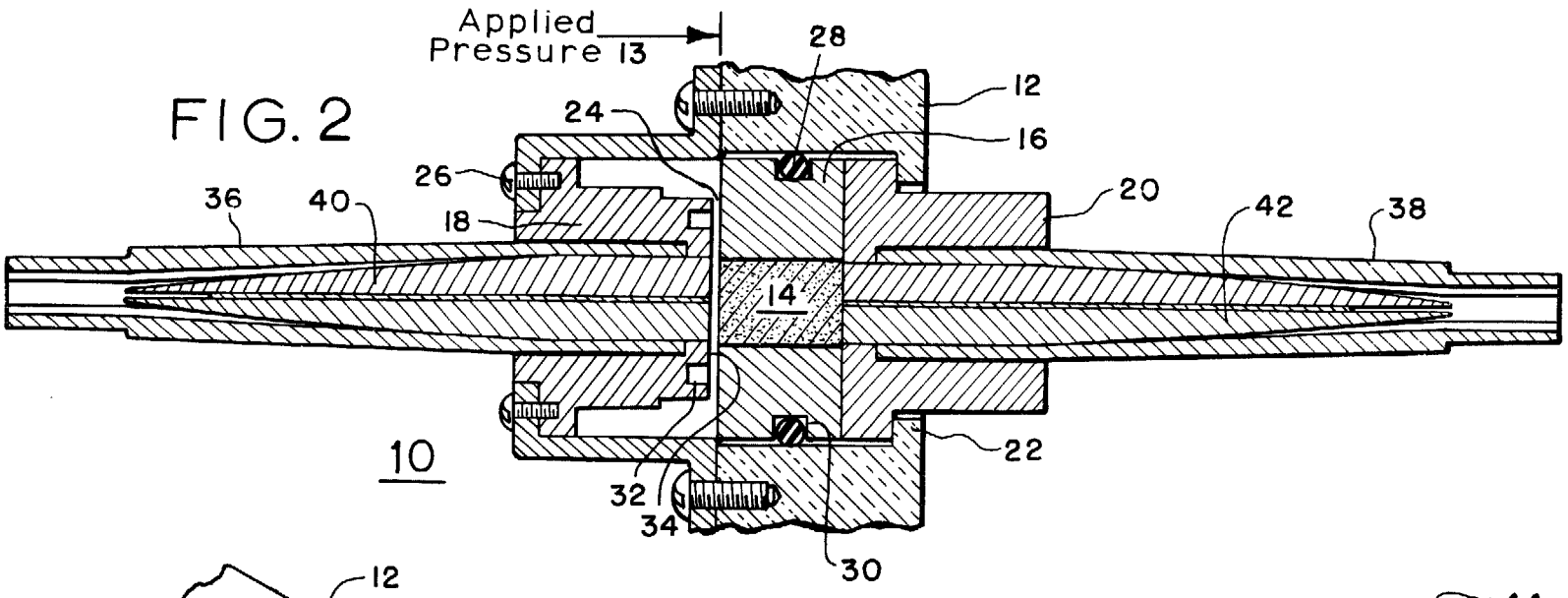
FIG. 2
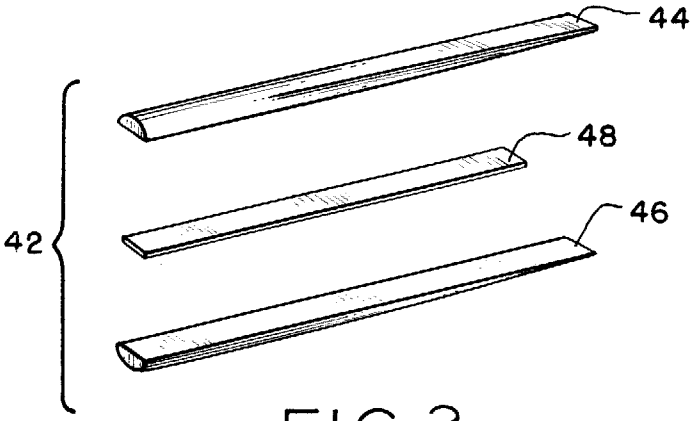
FIG. 3
FIG. 4
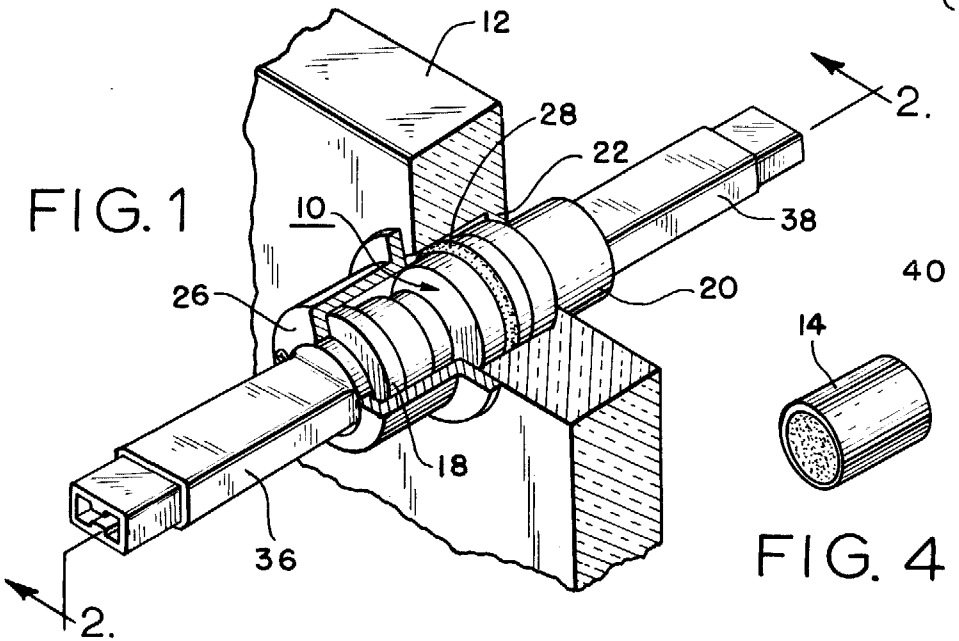
FIG. 1

MULTIMODAL HIGH PRESSURE WAVEGUIDE WINDOW

BACKGROUND

This invention relates to waveguide pressure windows and more particularly to windows providing low loss, wide band microwave transmission through a high pressure seal.

Waveguide pressure seals are commonly employed in microwave systems and related devices to provide for different pressures in different waveguide sections and to assure that either water or air is precluded from entering the inside of the guide. Usually, the waveguide window is placed in a location where it is convenient to disconnect or connect the various components or at places where the guide traverses a barrier separating one environment from another. The purpose of creating high pressure waveguide structures is to maintain relatively constant conditions in the waveguide itself irrespective of the change in evironment, temperature, ambient humidity, and the presence or absence of water.

When waveguide pressurization is not maintained, there is a tendency to encounter problems regarding Rf conduction and changing impedance. Moreover, condensation has a tendency to form in an unpressurized and unsealed waveguide which creates the deleterious condition of arcing and shorting. High pressure wavegides overcome this problem and if the seals are appropriately maintained, the inside of the waveguide may be filled with a dielectric gas to preclude moisture and when raised to positive pressure levels, improve power handling capability. The capability to withstand high pressure is not easily acquired and maintaining a low insertion loss over band width ratioed at 2.4:1 is difficult to attain. For example, Trousdale U.S. Pat. No. 3,001,160 discloses a high pressure waveguide window employing a dielectric plug having a transitional length equal to $\lambda/4$ and an overall plug length equal to $\lambda/2$. The plug material suggested by Trousdale includes teflon and polystyrene. This design and the materials employed are characteristic of a structure for narrow band width performance and gives no consideration to problems relating to high levels of hydrostatic pressures contemplated by this invention. Consonant with considerations as used above, the need arises to effectively provide a watertight seal in combination with a microwave window where the waveguide traverses a barrier as for example when an antenna, enclosed within a sealed radome, enters through the bulkhead of a submarine or the like to a microwave receiver. It is essential that sea pressure is prevented from entering the submarine in the event that the radome seal integrity is compromised.

SUMMARY

A multimode waveguide window couples microwave Rf from one side of a barrier to another with a minimum of insertion loss. The dominant mode propagates through the window without rotation and higher order modes are caused to attenuate. The cylindrical window is fabricated from fused silica, ultrasonically tinned and soldered around its circumference in place within a housing. Elongated "duck-billed " shaped linear fused silica tapers abut the end section of the window to provide for an even transition of the microwave energy. The linear fused silica tapers are each provided with a mica resistance vane for the attenuation of higher order modes, and the ridges in the waveguide are tapered toward the window to assure no rotation of the waves as they traverse the circular portion thereof. A wide band choke design, consisting of an axial shorted quarter wavelength section plus a radial quarter wave section at the window interface is employed to minimize insertion loss. As endless 0-ring resilient seal is engaged between the waveguide window housing and the barrier to maintain required pressure.

OBJECTS

It is an object of the present invention to provide a high pressure waveguide seal capable of withstanding hydrostatic pressure.

Another object of the present invention is to provide a waveguide seal capable of withstanding hydrostatic pressures in excess of 1000 psi.

A further object of the invention is to provide a waveguide window capable of transmitting microwave energy over a frequency band width of 2.4 to 1.0 with extremely low insertion losses.

Another object of the invention is to provide a waveguide window which combines the low loss characteristics with high pressure (hydrostatic) capability for high performance as well as high efficiency so that the window has a minimum attenuation to high frequency energy and an improved hydrostatic seal.

Other objects, advantages and novel features will be apparent when considering the following description in combination with the drawing wherein:

DRAWING

FIG. 1 is a prospective view of the high pressure waveguide window and bulkhead;

FIG. 2 is a cross-sectional view of the waveguide window shown in FIG. 1;

FIG. 3 is a prospective view of the silica tapers and the mica resistance vane; and FIG. 4 is a prospective view of the cylindrical silica window.

DESCRIPTION OF OPERATION

Referring to FIG. 1, waveguide window assembly 10 is disposed in pressure bulkhead 12. The bulkhead may be a metal surface, the thickness of which depends upon various structural considerations of its intended use. For example, each structure may be that of a hull of a ship or submarine which withstands hydrostatic pressure 13. The general purpose of waveguide window structure 10 is to provide an Rf connection between a device located on the inside of a barrier or bulkhead 12 as for example a microwave receiver or transmitter to another device located on the opposite side of the bulkhead. Typically, an antenna located on the outside of a submarine may be electrically connected by the waveguide window structure 10 to electronic components in the working compartment of the ship. Since the waveguide structure from the antenna (not shown) must pass through bulkhead 12, it is extremely important that sufficient hydrostatic seal exist so that there is no water leakage when exposed to hydrostatic pressures 13 such as when the submarine travels to the various depths of the ocean. Also in the event that debris, rocks or other formations hit the antenna structure or the waveguide on the outside of the vessel and causes the structure or supporting waveguide to be broken off, the waveguide window seal at the bulkhead must be sufficient to keep the water from entering the ship. Although the particular application of the invention relates to a waveguide window particularly adapted for the use with submarines, it should be obvious that the structure described provides a highly efficient seal capable of many uses where it is important that the device provide for high pressure sealing on either one or both sides of the barrier.

Waveguide window 14 as shown in FIG. 4 is made of fused silica having deposited thereon a surface capable of effecting a solder. The window is soldered to the housing 16 around the circumference. Although a variety of materials may be employed as a waveguide window 14, silica is preferred because of its extremely low dissipation factor (.00025 at $2.5 \times 10^{10}$ Hz); the stability of dielectric constant at elevated frequencies (3.78 to $2.5 \times 10^{10}$ Hz); the numerical value of dielectric constant (3.78) to provide physical compatibility between round and ridged waveguide cross-sections and structural properties. However, any material may be selected in lieu of silica as long as the above required properties are recognized.

Referring to FIG. 2, housing 16 may be made of any metallic material which displays the characteristics of a high structural capability and able to maintain a thermal co-efficient which matches that of the window 14. Invar has been used to satisfy thermal compatibility and is plated with a thin metal film (such as gold) which tends to offer high conductivity and retard corrosion. The window 14 and the housing 16 form a transition assembly 18 having a choke disposed on one side thereof and a second transition guide section 20 with butted metallic coupling disposed on the other. Transition assembly 20 engages a circular lip 22 on metal barrier 12 to serve as a retainer. The transition sections 18 and 20 may be made of any metal which exhibits stability to corrosive atmospheres or may be plated with a thin metal film to retard corrosion. The purpose of the choke is to assure Rf continuity at the junction 24 where the choke meets the housing. The choke contained guide section 18 is shown in combination with metal retaining ring and screws 26 which provide a mechanical constraint to the assembly as it enters the barrier or bulkhead 12. Any method of fastening which provides appropriate alignment may be used. An endless 0-ring type seal 28 positioned in annular goove 30 provides a seal for the window when retaining ring and screws 26 are tightly secured to barrier or bulkhead 12. Electrically, the choke provides two quarter wavelength sections. The outer quarter 32 provides an impedance in the order of several times the inner section 34. This arrangment reduces the choke sensitivity to frequency variation and the design is such that a low impedance is reflected from the internal guide surface at 34. The half wavelength is designed so that the low impedance occurs at a quarter wave distance from any choke separation between the choke 18 and the housing 16 thereby placing a high impedance (or a current minimum) in this region. This procedure allows the input transition to be relatively insensitive to the location of the particular metal surface resulting from machining tolerance differences.

Transition flanges 18 and 20 each have a circular hole disposed in their respective centers and flange 18 has input linear taper 36 soldered thereto. The solder is effected around the outer circumference of the linear taper 36 which tightly fits against and is soldered to the inner surface. The input taper 36 extends from choke flange 18 to a typical ridged waveguide connector (now shown) which may lead to an antenna or similar device. The ridged waveguide may be coupled to its mating structure by any method capable of maintaining microwave electrical continuity at the joint.

Through the length of the linear taper the cross-section changes from rectangular to circular and the ridges are tapered toward the window to maintain stability of the dominant microwave mode. The input linear taper 36 as well as the output linear taper 38 (which is identical to input taper 36) may be fabricated by any well known manufacturing process including the use of electroforming of copper over aluminum mandrels polished to provide for efficient operation at microwave frequencies. A standard caustic solution may then be employed to remove the mandrel following the completion of the electroforming process. The output taper 38 may be manufactured in a manner identical to the input taper 36 and is soldered to the internal annular surface of coupling 20.

Input and output fused silica linear tapers 40 and 42 are provided in each of the input and output linear waveguide tapers. The purpose of the fused silica tapers is to provide for a smooth and efficient Rf transition between the free space in the rectangular ridged air dielectric waveguide and the fused silica filled round cross-section represented by window 14 as shown in FIG. 4. Input and output tapers 40 and 42 are made of two symmetrical havles 44 and 46 and are identical in size and have sandwiched between each half a resistive coated mica vane 48 for attenuating all higher order modes which contain electric field vectors which are perpendicular to its planar surfaces. Mica vane 48 does not extend to the tapered ends of the halves. Imput taper 40 is epoxy cemented into linear taper 36 and positioned so that the mica resistance vane surface is parallel to the wide axis of the rectangular ridged waveguide. There is no mechanical connection between silica taper 40 and the waveguide window at junction 24. Output silica taper 42 is fastened and positioned in output linear taper 38 in a manner identical to the input taper. The end portion of the silica taper 42 is machined to be flush with the edge of coupling 20 so that a contiguous close fitting connection is effected between the silica taper and the waveguide window 14.

This device provides a sealed structure capable of efficiently transmitting Rf energy through a metal bulkhead or other barrier. Also dielectric gas may be provided to the internal portion of the waveguide for precluding the development of moisture or condensation.

I claim:

1. A multimodal microwave waveguide window for traversing a metal barrier comprising:

a hollow input taper section having a first and a second end portion, said first end portion having a rectangular cross-section and said second end portion having a circular cross-section.

a cylindrical silica window coupled to said second end portion;

a hollow output taper section having a first and a second end portion, said first end portion having a rectangular cross-section, said second end portion being contiguously disposed against said cylindrical window;

a first pair of "duck-billed" shaped tapers disposed in said input taper for precluding rotation of RF energy;

a second pair of "duck-billed" shaped tapers disposed in said hollow output taper section also for precluding rotation of RF energy;

a quarter wave transforming means disposed between said input taper and said waveguide window for matching impedance between said hollow input taper section and the cylindrical window.

2. The multimodal microwave waveguide window as claimed in claim 1 wherein the quarter wave transforming means includes an annular ring disposed around said hollow input taper section.

3. The multimodal microwave waveguide window as claimed in claim 1 wherein the cylindrical silica window further includes a metal coating deposited around the circumference thereof.

4. The multimodal microwave waveguide window as claimed in claim wherein the first and second pair of "duck-billed" shaped tapers also include a mica pad.

* * * * *